US007731038B2

(12) United States Patent
Hluchan

(10) Patent No.: US 7,731,038 B2
(45) Date of Patent: Jun. 8, 2010

(54) PROMOTIONAL DISPLAY SYSTEM

(75) Inventor: Erik S. Hluchan, Deep River, CT (US)

(73) Assignee: Structural Graphics, LLC, Essex, CT (US)

( * ) Notice: Subject to any disclaimer, the term of this patent is extended or adjusted under 35 U.S.C. 154(b) by 550 days.

(21) Appl. No.: 11/728,924

(22) Filed: Mar. 27, 2007

(65) Prior Publication Data

US 2007/0227921 A1 Oct. 4, 2007

Related U.S. Application Data

(60) Provisional application No. 60/786,644, filed on Mar. 28, 2006.

(51) Int. Cl.
*A47G 29/00* (2006.01)

(52) U.S. Cl. ..... 211/72

(58) Field of Classification Search ..... 211/72, 211/73; 248/174; 446/415, 418; 40/124.08; 206/744, 741, 745; 229/120.08, 120.14
See application file for complete search history.

(56) References Cited

U.S. PATENT DOCUMENTS

| | | | | | |
|---|---|---|---|---|---|
| 155,970 | A | * | 10/1874 | Platz | 446/415 |
| 1,254,639 | A | * | 1/1918 | Lang | 211/72 |
| 1,499,891 | A | * | 7/1924 | Storer | 40/124.08 |
| D71,940 | S | * | 2/1927 | Hansen | D6/453 |
| 1,699,875 | A | * | 1/1929 | Burgess | 248/152 |
| 1,938,919 | A | * | 12/1933 | Marsh | 211/73 |
| 2,142,826 | A | * | 1/1939 | Rosello | 248/174 |
| 2,148,279 | A | * | 2/1939 | Sandberg | 40/124.08 |
| 2,261,280 | A | * | 11/1941 | Pennebaker et al. | 211/24 |
| 2,267,378 | A | * | 12/1941 | Snelling | 211/69.9 |
| 2,324,232 | A | * | 7/1943 | Pantalone | 211/73 |
| 2,421,850 | A | * | 6/1947 | Ringler | 206/189 |
| 2,636,600 | A | * | 4/1953 | Denton et al. | 206/306 |
| 2,824,394 | A | * | 2/1958 | Lohnes | 40/124.13 |
| 3,002,722 | A | * | 10/1961 | Cote | 248/174 |
| 3,092,927 | A | * | 6/1963 | Luchsinger | 446/397 |
| 3,241,660 | A | * | 3/1966 | Cathcart, Jr. et al. | 206/780 |
| 3,429,451 | A | * | 2/1969 | Samsing | 211/72 |
| 3,455,498 | A | * | 7/1969 | Gadiel | 229/117 |
| 3,514,031 | A | * | 5/1970 | Burgess | 229/120.14 |
| 3,594,937 | A | * | 7/1971 | Luchsinger | 40/124.03 |
| 3,990,177 | A | * | 11/1976 | Daraux | 446/418 |
| 5,106,332 | A | * | 4/1992 | Segan et al. | 446/415 |
| 5,803,748 | A | * | 9/1998 | Maddrell et al. | 434/317 |
| 5,830,037 | A | | 11/1998 | Mastandrea, Jr. | |
| 5,971,168 | A | * | 10/1999 | Proulx | 211/85.4 |
| 6,102,342 | A | * | 8/2000 | Dunn | 248/83 |
| 6,269,961 | B1 | * | 8/2001 | Porcelli | 211/70.7 |
| 6,467,437 | B2 | * | 10/2002 | Donovan et al. | 119/798 |
| 7,537,121 | B2 | * | 5/2009 | Markson et al. | 206/745 |

* cited by examiner

*Primary Examiner*—Sarah Purol
(74) *Attorney, Agent, or Firm*—Melvin I. Stoltz

(57) ABSTRACT

By providing a pre-printed promotional system which employs two cooperating panels securely affixed to each other, with each panel being movable between a folded, compacted position and an unfolded, extended position, a unique, hands-on, printed, visually exciting and interest generating advertising/promotional product is attained. In addition, in the preferred construction of the present invention, the promotional system of the present invention is constructed to produce a snapping or cracking sound whenever the promotional system is moved between its two alternate positions. Although the creation or production of a sound is not required, it has been found that the sound produced further enhances consumer surprise and interest.

20 Claims, 13 Drawing Sheets

1A

1B

1C

2A

2B

2C

3A

3B

3C

4A

4B

4C

4D

11A

11B

11C

PROMOTIONAL DISPLAY SYSTEM

RELATED APPLICATIONS

Figure 1:
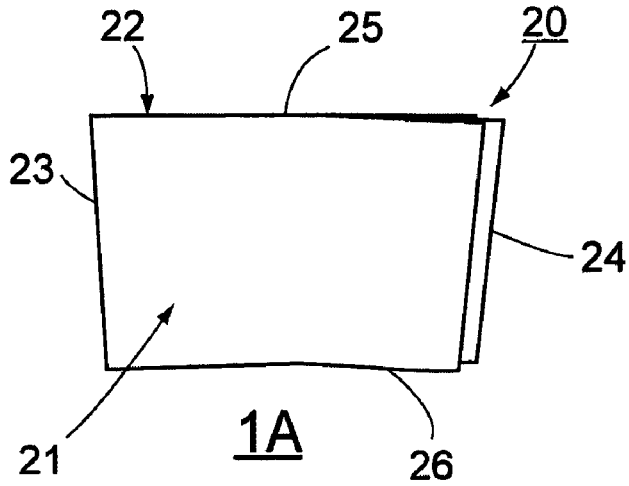
Figure 1:
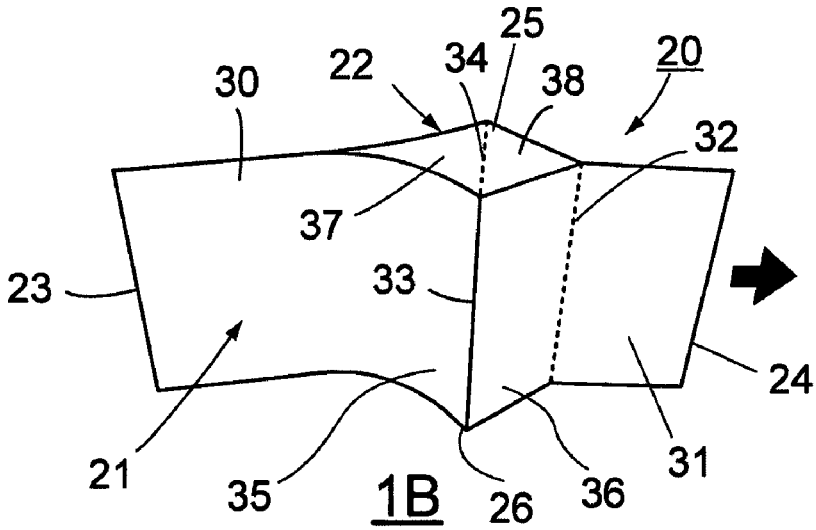
Figure 1:
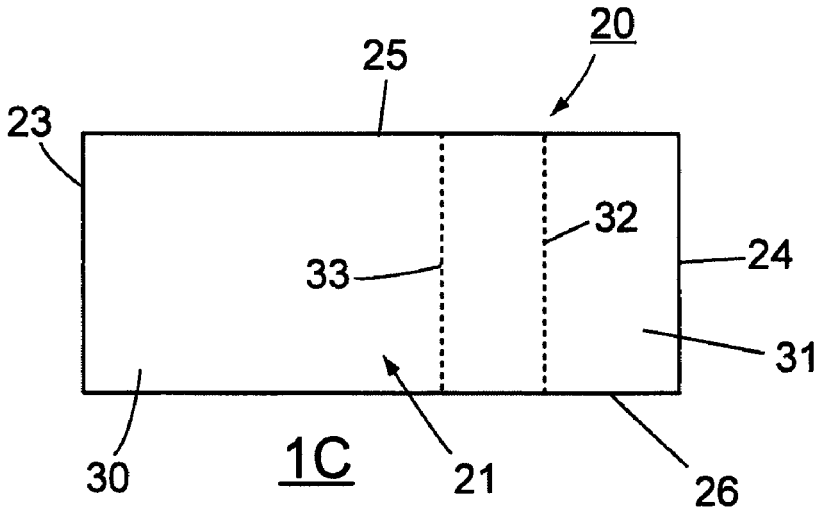

This application is related to U.S. Provisional Patent Application Ser. No. 60/786,644, filed Mar. 28, 2006 entitled PROMOTIONAL DISPLAY SYSTEM.

TECHNICAL FIELD

This invention relates to advertising/promotional display systems and, more particularly, to audible advertising/promotional display systems for providing visually exciting and interest generating products.

BACKGROUND ART

With the ever-increasing quantity of products and services being offered to consumers, substantial interest has been given to promotional systems for advertising such products and services. In this regard, a wide variety of advertising displays and promotional literature has been created and distributed to consumers. However, due to the deluge of material to which average consumers are constantly exposed, greater emphasis has been placed on developing eye-catching visual displays and promotional material which stand out as being visually unique in order to receive consumer attention.

Although various novelty products and printed displays have been created in an attempt to satisfy this demand, these prior art products have failed to provide the desired interest generating result with production costs which advertisers are capable of justifying. In attempting to generate a unique advertising display, some prior art products have employed complex folding systems which produce a three-dimensional display when activated or unfolded. However, in spite of the unique visual appearance generated by such products, the overall cost of production and complexity of the assembly of these systems has prevented such prior art systems from becoming popular.

Other prior art displays have attempted to generate consumer interest by providing unique visual images or other indicia as an integral part of the display. However, these prior art attempts have also failed to generate the consumer interest being sought, largely due to an inability to physically involve the consumer in the promotion or display operation.

Furthermore, the ever increasing consumer demand seeks to obtain promotional products which produce unique and/or surprising results. In this regard, consumers are continuously seeking products which will produce a surprising visual and/or audible effect when used.

Therefore, it is a principal object of the present invention to provide a printed advertising or promotional product which is capable of being produced at a reasonable cost and provides an exciting, interest generating display.

Another object of the present invention is to provide a printed advertising or promotional product having the characteristic features described above, which enables the consumer to physically control the presentation of the display in a unique, hands-on manner.

Another object of the present invention is to provide a printed advertising or promotional product having the characteristic features described above, which is capable of mass production and assembly.

A further object in the present invention is to provide a printed advertising or promotional product having the characteristic features described above, which provides a unique, eye-catching, exciting and surprising visual change and/or an audible sound generation which is produced in response to action taken by the consumer.

Other and more specific objects will in part be obvious and will in part appear hereinafter.

SUMMARY OF THE INVENTION

By employing the present invention, all of the difficulties and inabilities of the prior art are eliminated and a unique, hands-on, printed, visually exciting and interest generating advertising/promotional product is attained. This desirable and previously unattainable result is realized in the present invention by providing a unique, pre-printed promotional system which can be produced in a wide variety of alternate forms and/or configurations. However, regardless of the printed form or configuration desired, the promotional system of the present invention employs two cooperating panels securely affixed to each other, with each panel being movable between a folded, compacted position and an unfolded, extended position.

In addition, in the preferred construction of the present invention, the promotional system of the present invention is constructed to produce a snapping or cracking sound whenever the promotional system is moved between its two alternate positions. Although the creation or production of a sound is not required, it has been found that the sound produced further enhances consumer surprise and interest.

In the basic, principal construction of the present invention, the promotional system comprises two enlarged panel members forming a front panel and a rear panel with the opposed terminating ends of both panels being securely affixed to each other. Preferably, holding zones or sections are established directly adjacent the terminating ends of the panels which are affixed to each other, with the holding sections or zones being formed by securely affixing an enlarged area of both the front panel and rear panel to each other.

Finally, a first fold line is formed along the edge of one of the holding zones/sections, while a second fold line is formed between the first fold line and the opposed terminating end of the panels, with the second fold line being constructed for extending outwardly as the two holding zones/sections are advanced towards each other. In this way, the promotional system is able to be quickly moved between a first folded, compacted position, and a second, unfolded and fully extended position. In addition, in the folded position, the holding zone/section with the fold line and the section between the two fold lines are nested between the remaining portion of the two panel members.

In order to further enhance the excitement and eye-catching visual appearance of the present invention, as well as providing enjoyment and surprising effects, the promotional system of the present invention can be constructed in a wide variety of alternate exciting configurations. In the principal, basic embodiment of the present invention, the front panel and rear panel are constructed with pre-printed indicia formed on all external surfaces, in order to provide a visual message, along with the hands-on movement of the promotional system from the first position to the second position.

In order to provide a further alternate visually exciting and interest generating configuration, various cut out zones may be formed in the front panel and/or the rear panel with additional indicia printed on the inside surfaces. In this way, added visual excitement and interest can be attained. Furthermore, consumer interest and enjoyment can be further enhanced by incorporating an interior panel member sandwiched between the front and rear panels which are affixed to each other to form the movable holding section. By printing indicia on this internal panel and aligning the indicia with cut out zones formed on the front and/or rear panel, further interest and excitement is achieved.

Furthermore, if desired, the promotional system of the present invention can be constructed with one of the pivoting panel portions being employed as a carrier for a product to be given to the user. Although a wide variety of alternate products can be presented to the consumer in this way, the presentation of a compact disc is a prime example, wherein the compact disc can be stored or hidden from view, and be revealed to the consumer as a surprise whenever the promotional system is moved into its fully extended configuration.

In addition, in an alternate variation of this construction, interior panels of the promotional system of the present invention can be constructed with three-dimensional producing die cut and/or pop-up elements integrally formed therein. Preferably, the die-cut, pop-up element remains hidden from view when the promotional system is in its first, compact position, and becomes revealed only upon movement of the promotional system into its fully extended position. By incorporating any desired unique, three-dimensional, pop up or extending die cut elements in one or more of the interior panels of the promotional system of the present invention, substantially enhanced excitement, interest, and surprise are realized.

In a still further alternate embodiment of the promotional system of the present invention, the system is constructed with a plurality of extendable segments. By forming one side of the panel member in a plurality of parallel sections or segments, each segment can be separately movable relative to the central panel portion. In addition, by incorporating any desired indicia and/or message on each separate segment, added interest and excitement is realized.

In a further additional variation of the basic construction, the promotional system is constructed with two separate and independent movable sections, each of which cooperate with opposed ends of a central zone or section. In addition, the central zone/section is formed by affixing the front and rear members to each other. In this way, two separate, movable sections are achieved, with further enhanced, visual excitement and interest being generated.

In addition to these unique alternate configurations in which the present invention can be constructed, the promotional system of the present invention can also be manufactured incorporating readily extendable foldable components formed in one or more corners of an enlarged panel section. In this way, a plurality of smaller foldable segments can be extended by the user whenever desired from an enlarged central panel. In this way, a further exciting, interest-generating, and visually distinctive printed promotional display capable of being conveyed to the user by the sponsor.

In accordance with the present invention, a still further alternate embodiment is achieved by forming the promotional system with the movable panel members being peripherally surrounded by a frame construction. As a result, the movement of the activation holding zone or section causes the interior panel to arcuately pivot or extend within the frame assembly. By employing this embodiment, substantially unique features and enhanced visual effects are attained.

The invention accordingly comprises an article of manufacture possessing the features, properties, and relation of elements which will be exemplified in the article hereinafter described, and the scope of the invention will be indicated in the claims.

THE DRAWINGS

Figure 2:
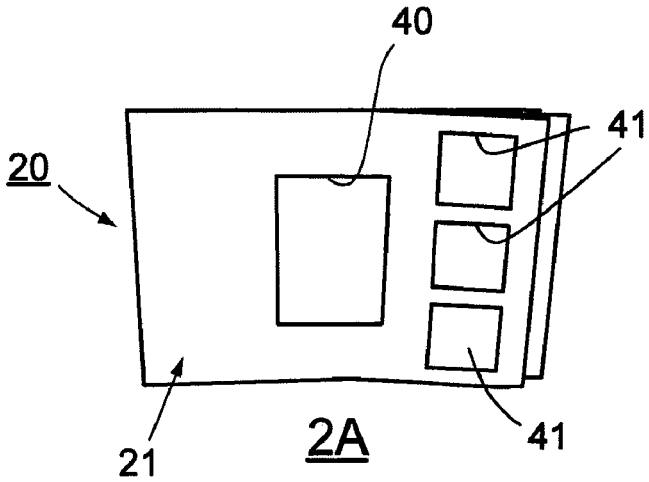
Figure 2:
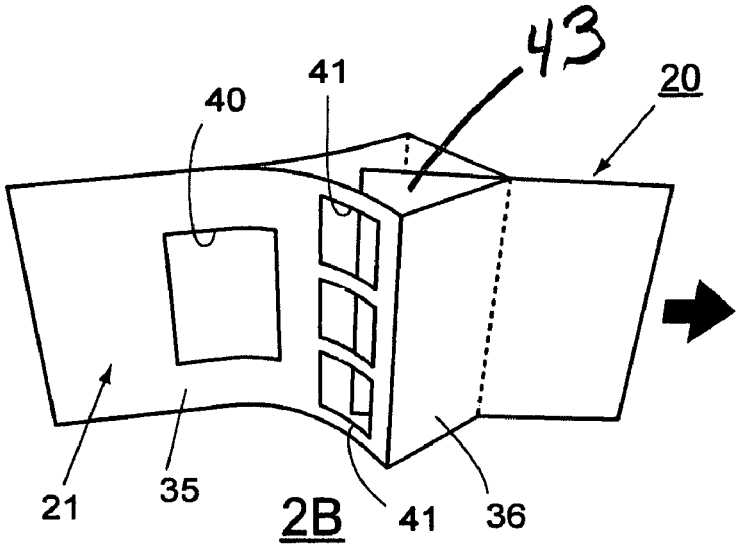
Figure 2:
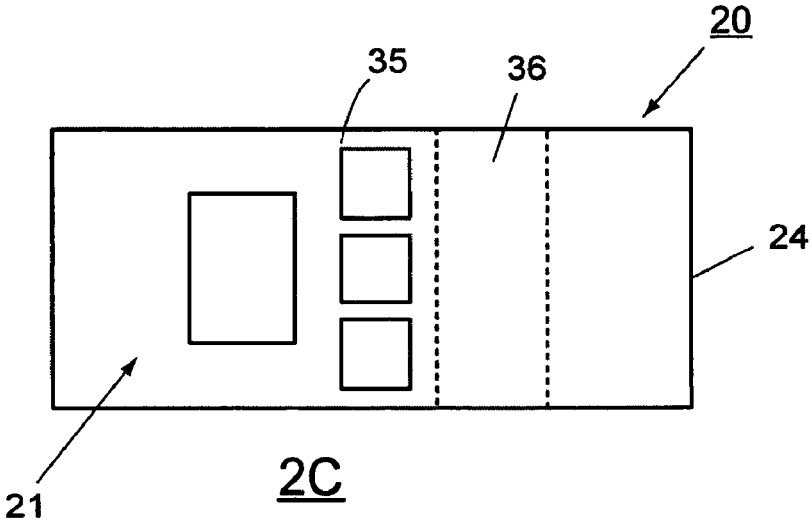
Figure 3:
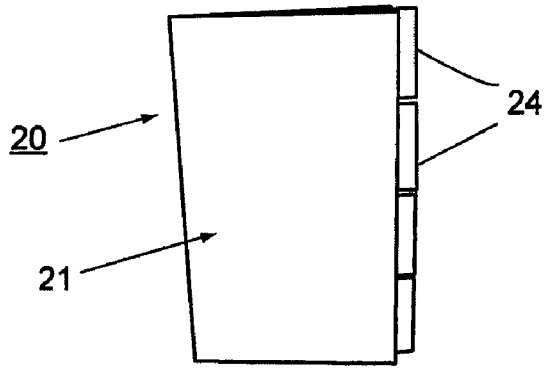
Figure 3:
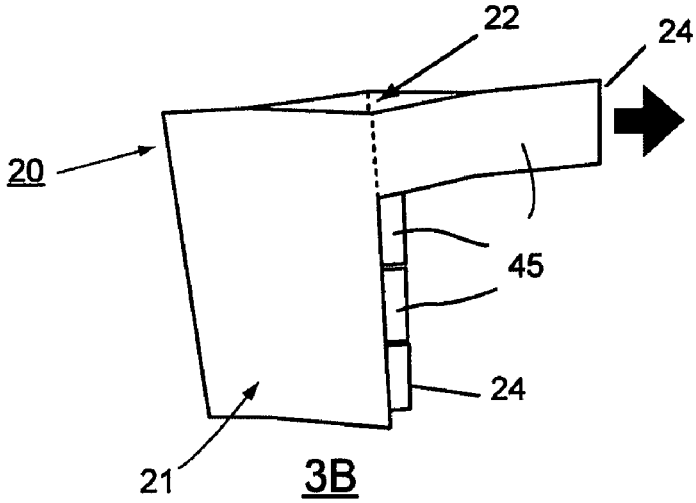
Figure 3:
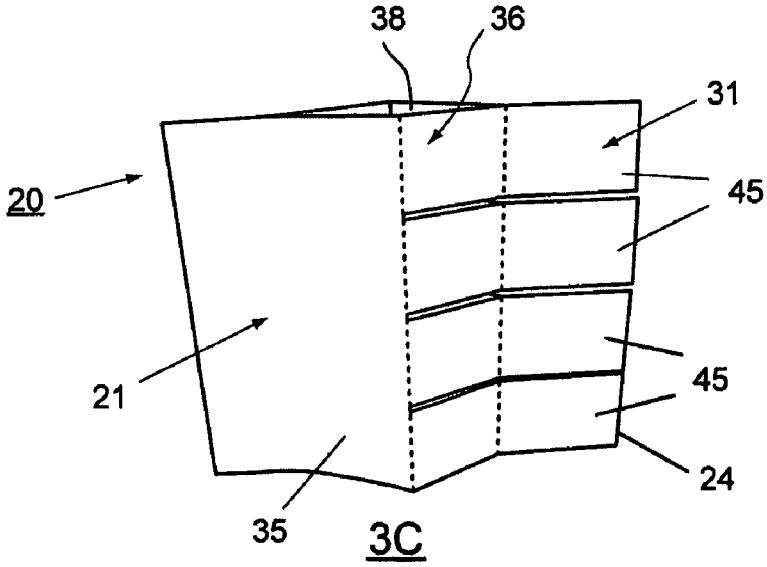
Figure 4:
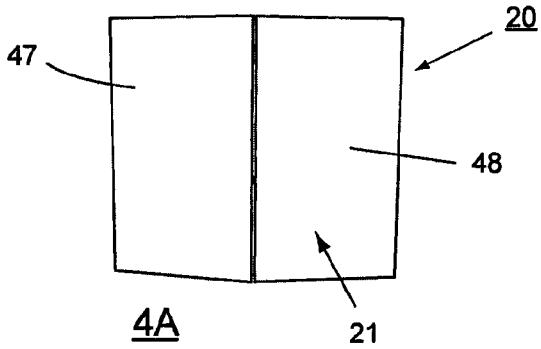
Figure 4:
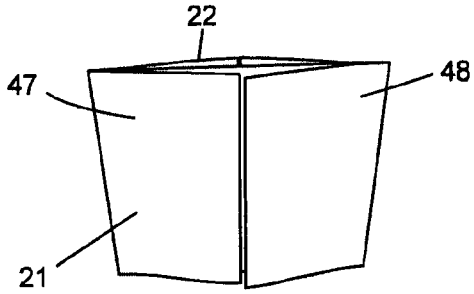
Figure 4:
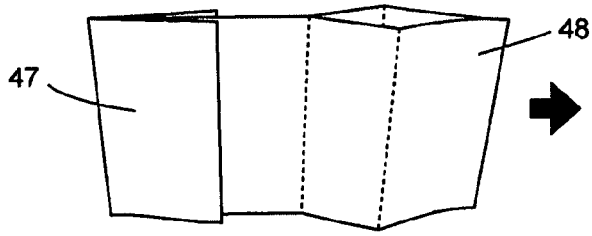
Figure 4:
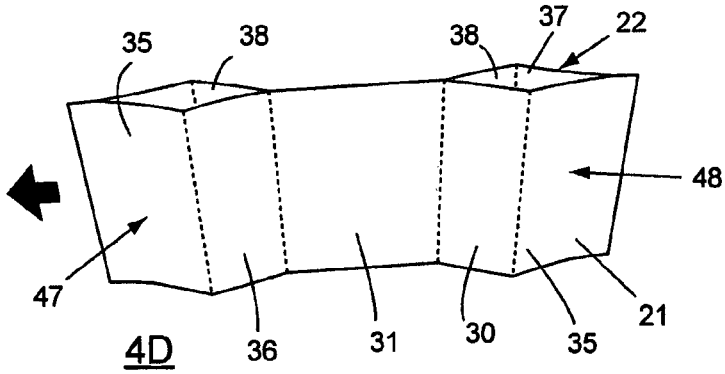
Figure 5:
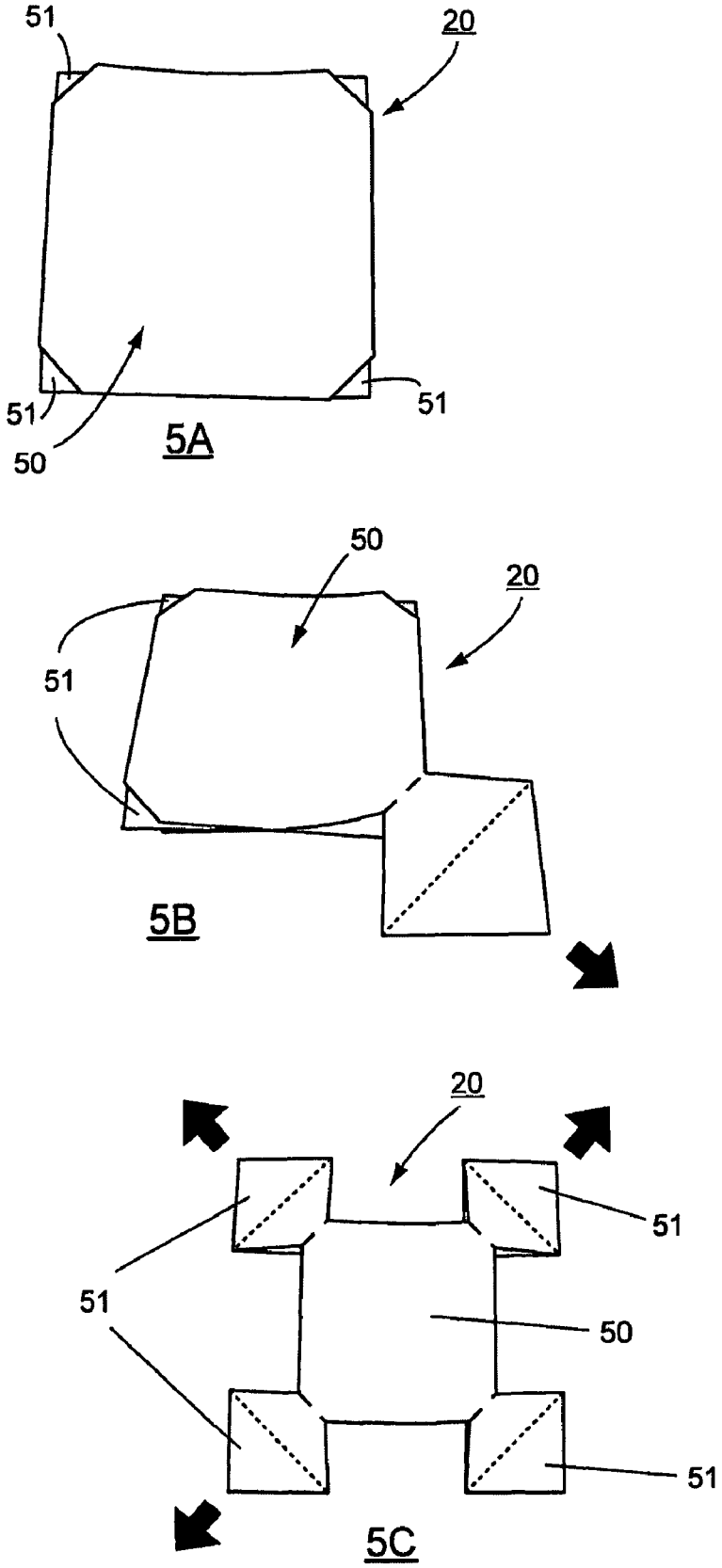
Figure 6:
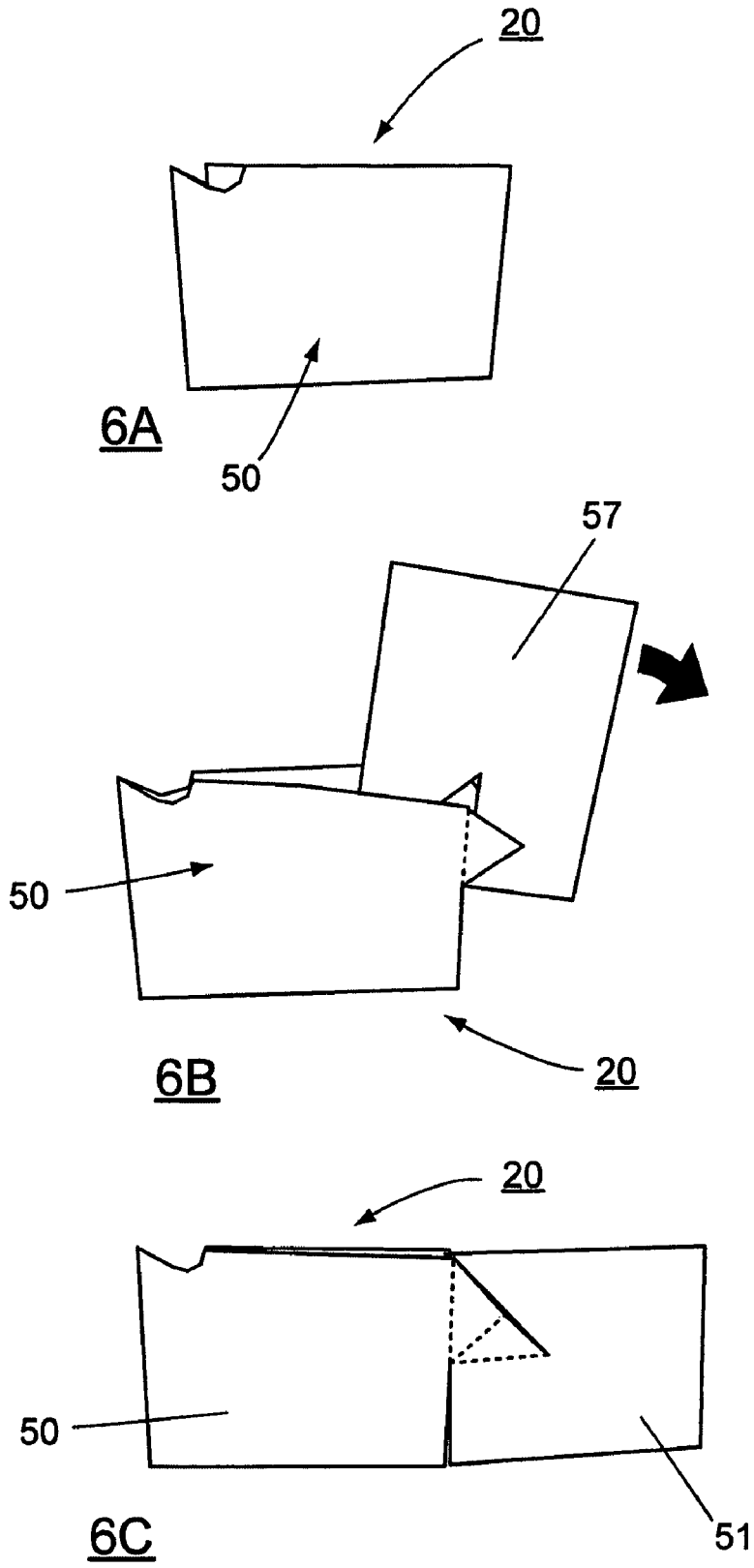
Figure 7:
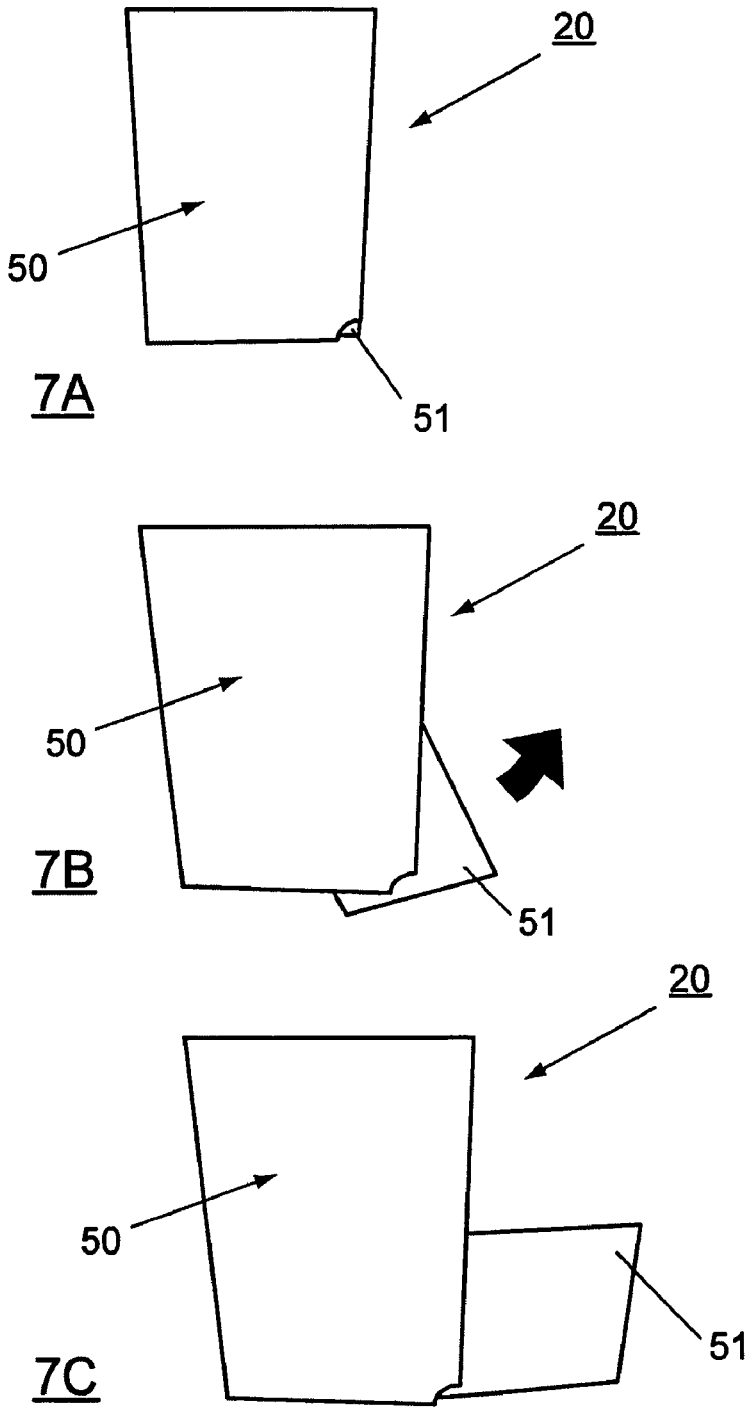
Figure 8:
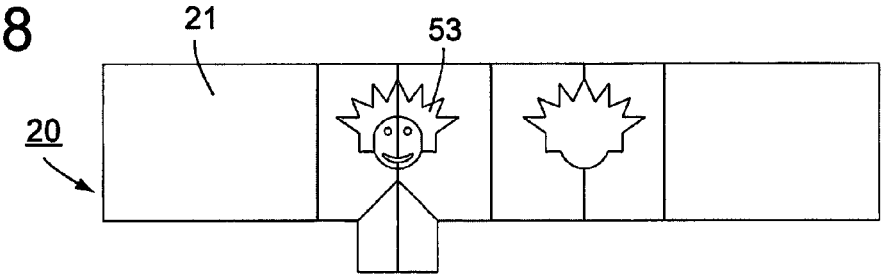
Figure 9:
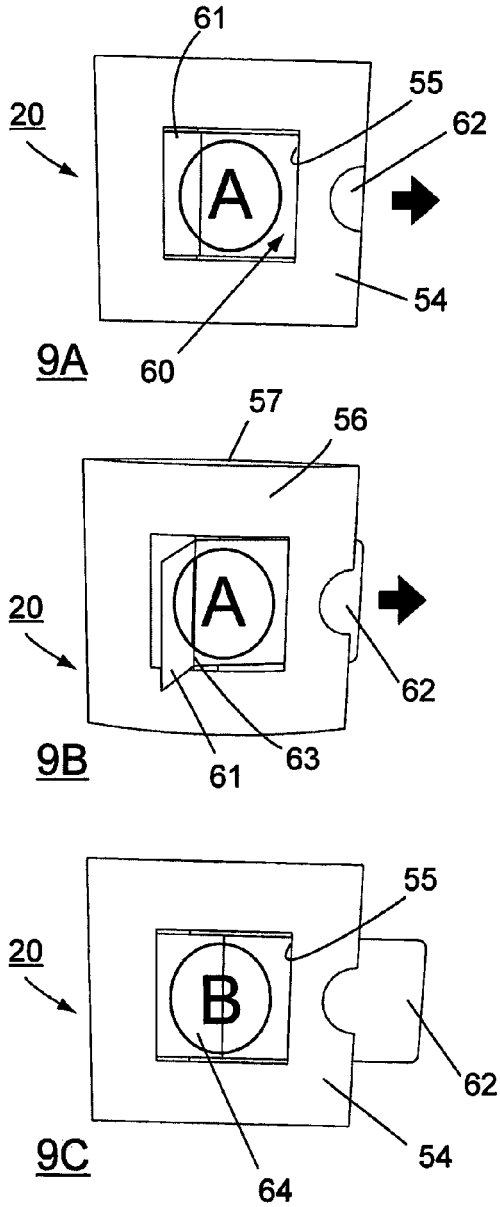
Figure 10:
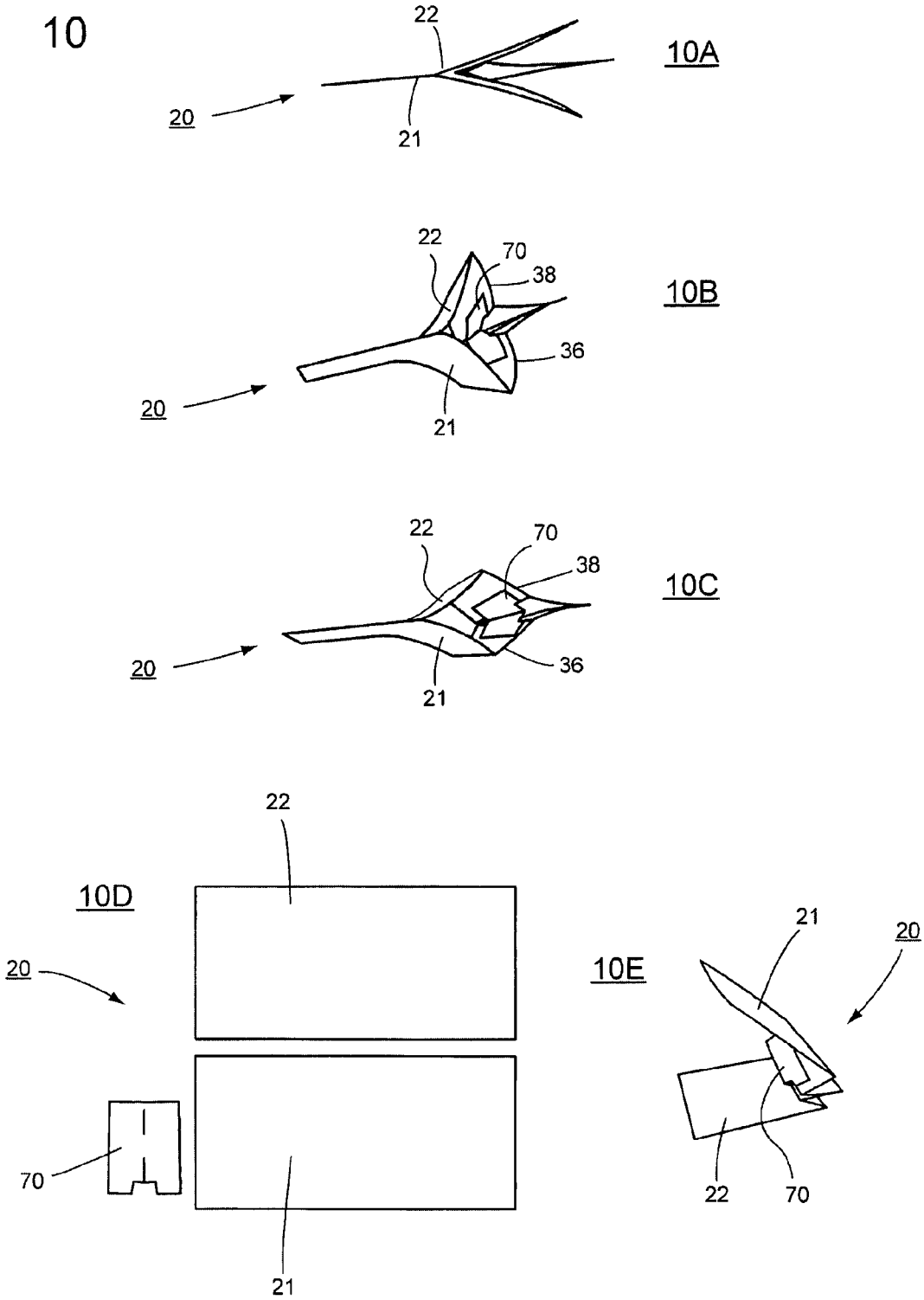
Figure 11:
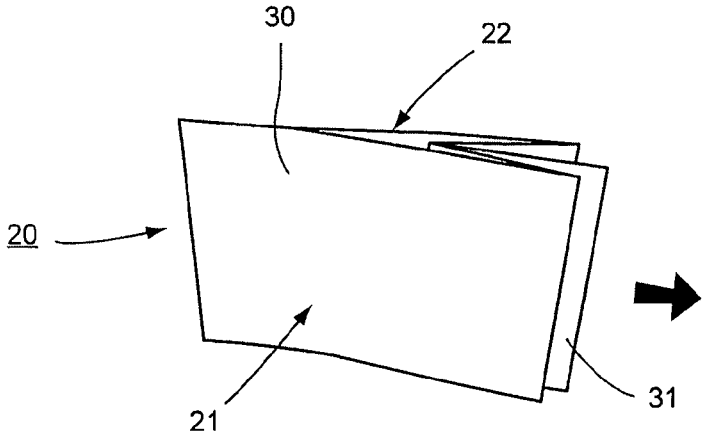
Figure 11:
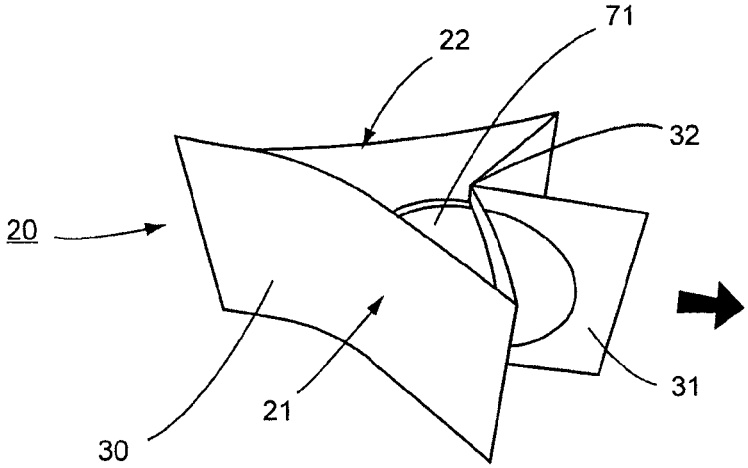
Figure 11:
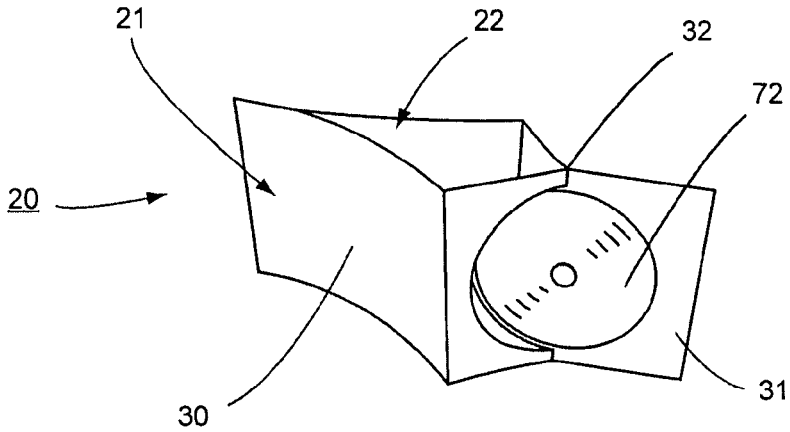
Figure 12:
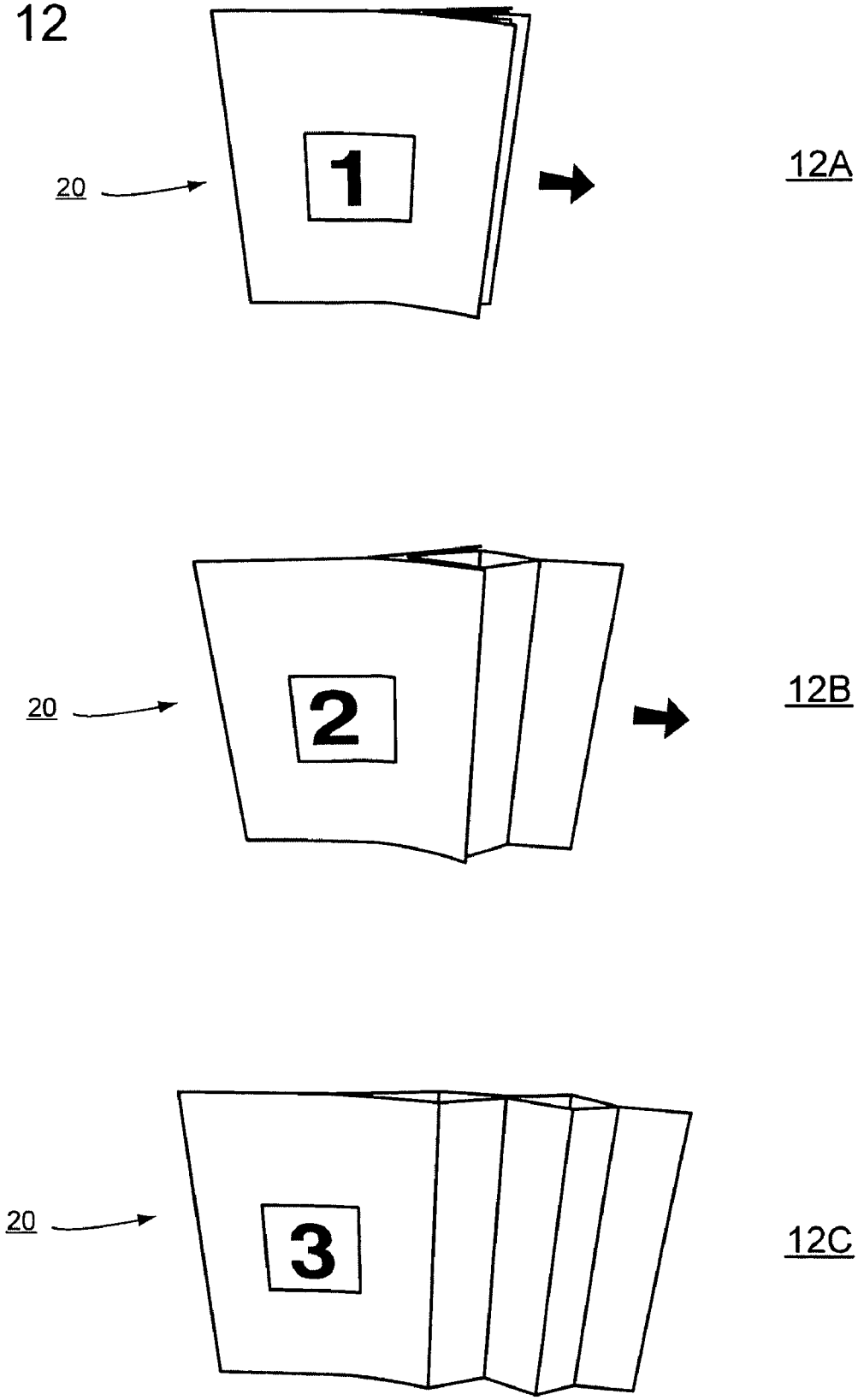
Figure 13:
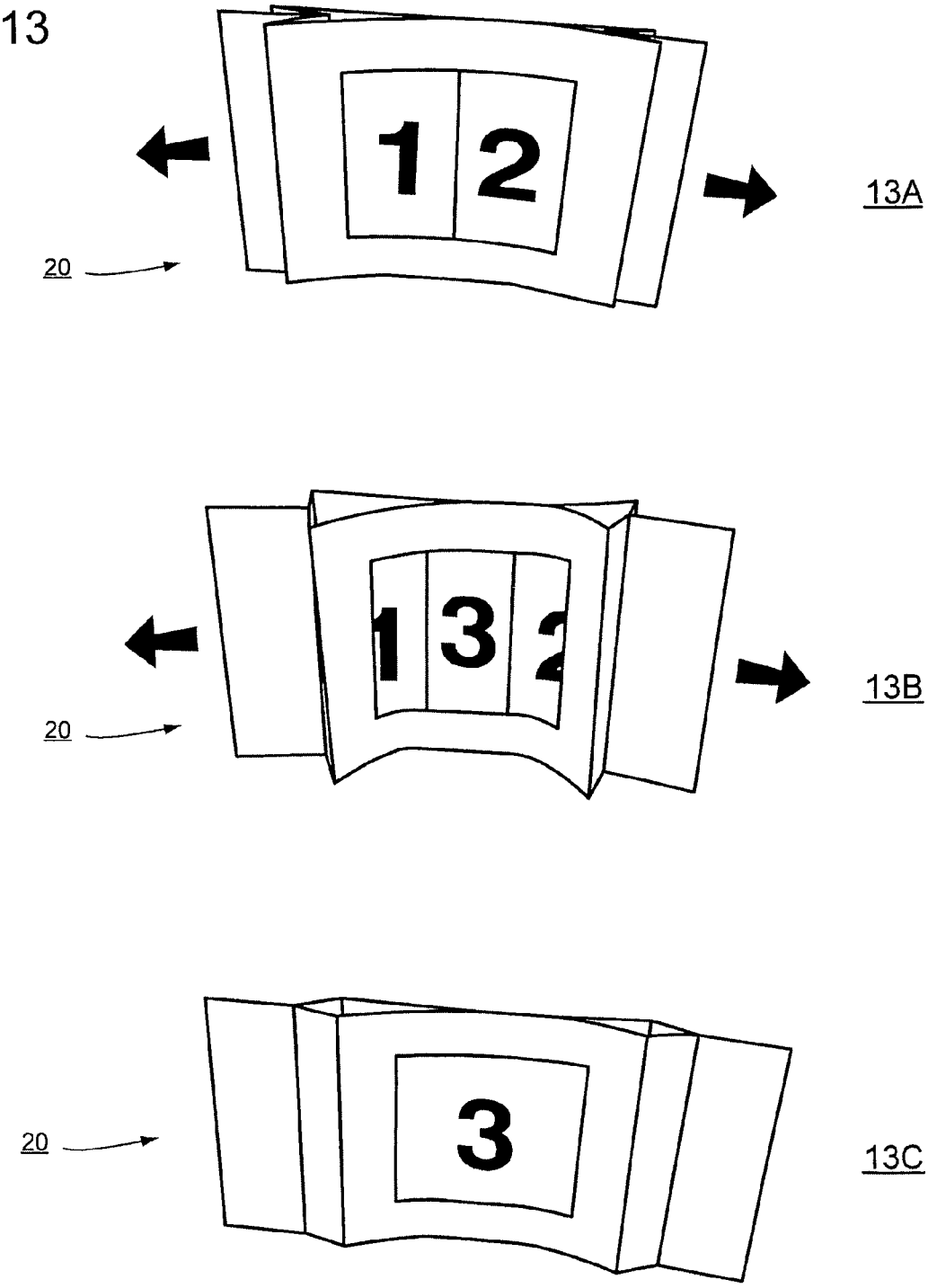
Figure 14:
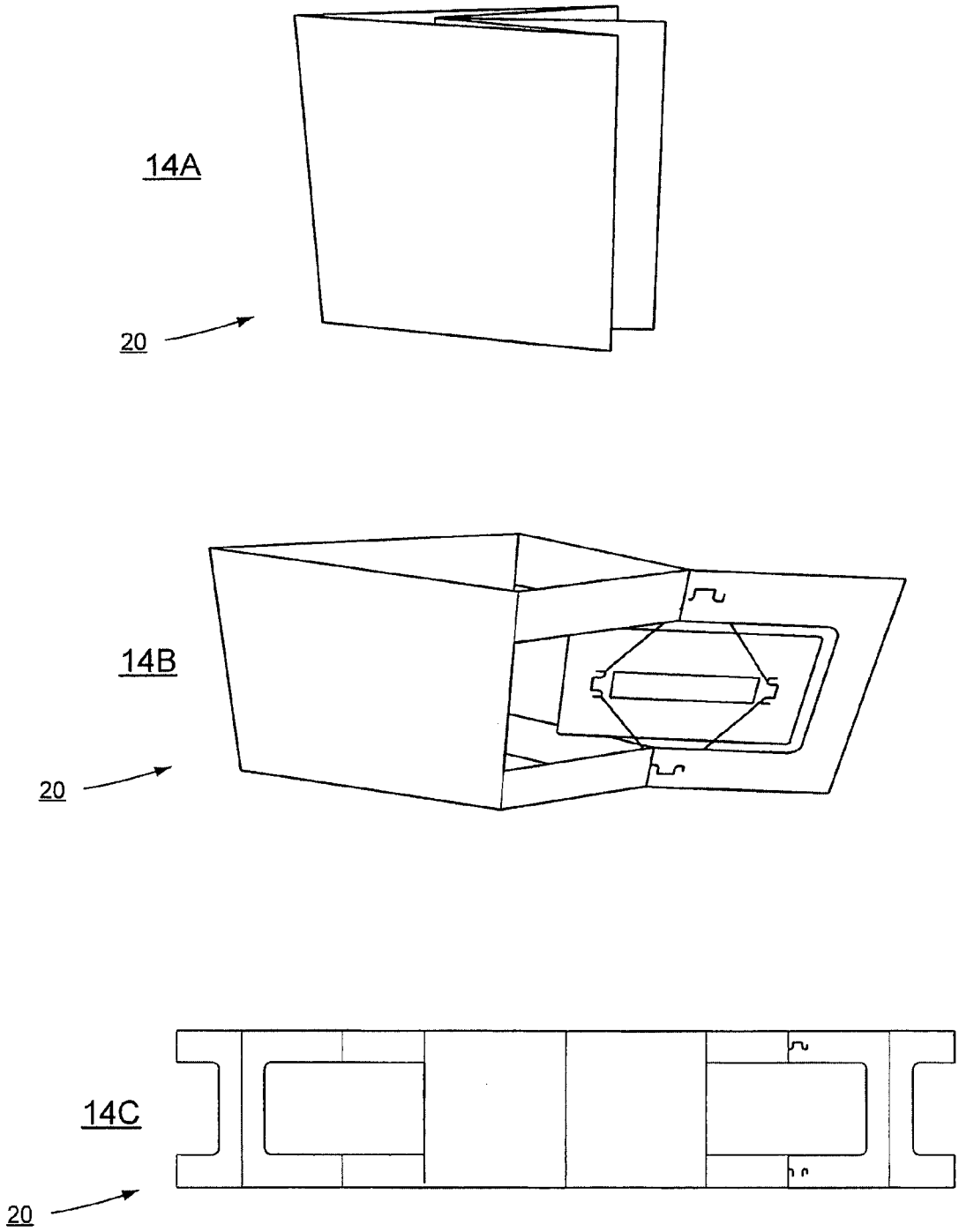

For a fuller understanding of the nature and objects of the present invention, reference should be had to the following detailed description taken in connection with the accompanying drawings, in which:

FIG. 1 comprising FIGS. 1A, 1B and 1C each represent three sequential perspective views of one embodiment of the promotional system of the present invention depicting the promotional system in the process of being moved from a folded, compacted position to an unfolded, fully extended position;

FIG. 2 comprising FIGS. 2A, 2B and 2C each represent three sequential perspective views of an alternate embodiment of the promotional system of the present invention depicting the alternate embodiment of the promotional system in the process of being moved from a folded, compacted position to an unfolded, fully extended position;

FIG. 3 comprising FIGS. 3A, 3B and 3C each represent three sequential perspective views of a further alternate embodiment of the present invention depicting the further alternate embodiment in the process of being moved from a folded, compacted position to an unfolded, fully extended position for one portion thereof;

FIG. 4 comprising FIGS. 4A, 4B, 4C and 4D each represent four sequential perspective views of a still further alternate embodiment of the present invention depicting the still further alternate embodiment in the process of being moved from a folded, compacted position to an unfolded, fully extended position;

FIG. 5 comprising FIGS. 5A, 5B and 5C each represent three sequential perspective views of another alternate embodiment of the present invention depicting this alternate embodiment in the process of being moved from a folded, compacted position to an unfolded, fully extended position;

FIG. 6 comprising FIGS. 6A, 6B and 6C each represent three sequential perspective views of another alternate embodiment of the present invention depicting this alternate embodiment in the process of being moved from a folded, compacted position to an unfolded, fully extended position;

FIG. 7 comprising FIGS. 7A, 7B and 7C each represent three sequential perspective views of a further alternate embodiment of the present invention depicting this further alternate embodiment in the process of being moved from a folded, compacted position to an unfolded, fully extended position;

FIG. 8 is a side elevation view of a still further alternate embodiment of the present invention depicted in a fully extended configuration and incorporating a unique visual, die cut, pop-up indicia display incorporated therein;

FIG. 9 comprising FIGS. 9A, 9B and 9C each represent three sequential perspective views of a still further alternate embodiment of the present invention depicting the still further alternate embodiment in the process of being moved from a folded position to an unfolded position;

FIG. 10 comprises FIGS. 10A-10E which depict a further alternate embodiment of the present invention with FIGS. 10A, 10B, and 10C representing sequential perspective views of this alternate embodiment in the process of being moved from a folded, compact position to an unfolded fully extended position, with FIG. 10D depicting the component forming this embodiment, while FIG. 10E is a perspective view of this embodiment partially disassembled;

FIG. 11 comprises FIGS. 11A, 11B, and 11C represent sequential perspective views of a still further alternate embodiment of the promotional system of the present invention depicting this alternate embodiment of the promotional system in the process of being moved from a folded, compact position to an unfolded, fully extended position;

FIG. 12 comprises FIGS. 12A, 12B, and 12C which represent sequential perspective views of a further alternate embodiment of the promotional system of the present invention depicting this alternate embodiment of the promotional system in the process of being moved from a folded, compact position to an unfolded, fully extended position;

FIG. 13 comprises FIGS. 13A, 13B, and 13C which represent sequential perspective views of another alternate embodiment of the promotional system of the present invention depicting this alternate embodiment of the promotional system in the process of being moved from a folded, compact position to an unfolded, fully extended position; and FIG. 14 comprises FIGS. 14A, 14B, and 14C, with FIG. 14A and 14B representing sequential perspective views of a still further alternate embodiment of the promotional system of the present invention depicting this alternate embodiment of the promotional system in the process of being moved from a folded, compact position to an unfolded, fully extended position, with FIG. 14C depicting a top plan view of this embodiment of the present invention disassembled.

DETAILED DISCLOSURE

By referring to FIGS. 1-14, along with the following detailed discussion, the construction and operation of several alternate preferred embodiments of promotional system 20 of the present invention can best be understood. However, as is evident from this disclosure, the present invention may be implemented in a wide variety of alternate constructions. Consequently, it is to be understood that the embodiments detailed herein and shown in the drawings are provided for exemplary purposes only and are not intended as a limitation of the scope of the present invention.

In FIG. 1, promotional system 20 is depicted in its basic form and construction comprising front panel member 21 and rear panel member 22. As depicted, front panel member 21 and rear panel member 22 comprises side edges 23 and 24, top edge 25 and bottom edge 26. In addition, in this construction, side edges 23 and 24 of both front panel member 21 and rear panel member 22 are securely affixed to each other.

In addition, promotional system 20 also incorporates two separate and independent holding zones or sections 30 and 31. Holding zone/section 30 is formed by securely affixing a portion of the rear surface of front panel member 21 to the adjacent, facing, front surface of rear panel member 22 which extends from side edges 23. Similarly, holding zone/section 31 is formed by securely affixing a portion of the rear surface of front panel member 21 to the adjacent, facing, front surface of rear panel member 22 which extends from side edges 24. Although the overall axial or longitudinal length of holding zone/sections 30 and 31 may comprise any size desired, in the preferred embodiment, holding zone/sections 30 and 31 each comprise an overall axial or longitudinal length ranging between about 10% to 35% of the overall length of panel members 21 and 22.

Furthermore, in the preferred construction of the present invention, promotional system 20 also incorporates fold lines 32, 33, and 34. As depicted, fold line 32 is formed parallel to side edges 24 and defines the overall width of holding zone/section 31. In the preferred construction, front panel member 21 and rear panel member 22 are securely affixed to each other throughout the entire area defined by holding zone 31, as established by side edges 24 and fold line 32.

Fold line 33 is formed in front panel member 21 extending parallel to fold line 32, while fold line 34 is formed in rear panel member 22 in juxtaposed aligned relationship with fold line 33, extending therein parallel to fold lines 32 and 33. In addition, fold line 33 forms flaps 35 and 36 in front panel member 21, while fold line 34 forms flaps 37 and 38 and rear panel member 22.

Since front panel member 21 and rear panel member 22 are separate from each other in the zone adjacent holding zone/section 31, flaps 35 and 36 of front panel member 21 and flaps 37 and 38 of rear panel member 22 move independently of each other, with fold lines 33 and 34 being constructed to extend outwardly from holding zone/sections 30 and 31. In this way, holding zone/section 31 is able to move between front panel member 21 and rear panel member 22, along with flaps 36 and 38, when in the folded, compact position. In this way, the folded, compact position is quickly and easily attained, preferably with side edges 24 extended outwardly for easy access. In addition, by merely pulling on side edges 24, holding zone/section 31, flaps 36 and 38 are quickly moved outwardly from their stored position into their fully extended position.

By employing this construction, promotional system 20 is capable of moving from a first, compact position, as depicted in FIG. 1A, to a fully extended position as depicted in FIG. 1C., with FIG. 1B showing the configuration of promotional system 20 in the process of completing its movement to its second position. As depicted, the user grasps edge 24 and effectively removes holding zone/section 31 from concealed engagement between the folded portions of front panel 21 and rear panel 22, revealing folded flaps 36 and 38, along with holding zone/section 31. By printing any desired indicia on the exposed surfaces of front panel 21 and rear panel 22, any desired message can be conveyed to the consumer in an eye-catching, visually stimulating manner.

As a further feature of the present invention, the material preferably employed for forming panel members 21 and 22 comprises cardboard or heavy paper stock which enables promotional system 22 operate repeatedly and continuously whenever desired by the user without suffering degradation. In addition, it has also been found that by employing material of a sufficient thickness or weight, the rapid removal of holding zone/section 31 from its concealed position between folded portions of front panel member 21 and rear panel member 22 causes the free surfaces of front panel member 21 and rear panel member 22 to contact each other, producing a surprise audible effect.

This surprise audible effect is also caused whenever holdings zone/section 31 is returned from its fully extended position back to its original, concealed position in a rapid manner. Typically, the audible effect produced consists of a snapping or cracking sound, which often surprises the user and adds entertainment and excitement to the use of promotional system 20.

In FIG. 10, which consists of FIGS. 10A-10E, an alternate construction of promotional system 20 is depicted wherein the production of the surprise audible effect is further enhanced. In this alternate construction, promotional system 20 is constructed in a manner substantially identical to the construction detailed above, incorporating front panel member 21 and rear panel member 22. As depicted, panel members 21 and 22 are assembled as shown in FIG. 1 and described above.

In this alternate embodiment, in order to further enhance and assure the production of a distinctive surprise audible effect, which is consistently and repeatedly achieved, promotional system 20 incorporates interior panel 70 which is mounted to flaps 36 and 38. In the preferred construction, panel 70 extends from flap 36 to flap 38, spanning fold line 32. As a result of this construction, with panel 70 incorporating a fold line formed substantially midway along the width thereof, panel 70 folds automatically with the folding of promotional system 20.

By employing this configuration, the desired audible sound is consistently and repeatedly created by the movement of panel 70 between its two alternate folded positions in combination with its position affixed to flaps 36 and 38. Furthermore, it has been found that the audible sound is created with a substantially enhanced volume, thereby assuring the repeated creation of the sound to the surprise of the user. As a result, the desired enhancement to promotional system 20 is achieved.

In FIG. 11, another variation of promotional system 20 is depicted which employs the basic configuration shown in FIG. 1 and described above. In this alternate construction, promotional system 20 comprises front panel member 21 and rear panel member 22, both of which are constructed in substantially the identical manner detailed above. However, in this variation, holding zone/section 30 incorporates panel 71 extending from fold line 32 for effectively creating an interior support panel 71 which is mounted between flaps 35 and 37 and is movable between two alternate positions.

Furthermore, in the preferred construction of this embodiment, support panel 71 is configured for securely retaining a desired component, such as compact disc, CD, and/or DVD 72. As a result, this embodiment of promotional system 20 is employable for a wide variety of alternate uses directed to compact discs, CDs, and/or DVD's 72. These various uses include storage, gift-giving, and/or sale or distribution of these components. As a result, this embodiment of promotional system 20 can be employed for a wide variety of alternate purposes.

In FIG. 2, an alternate embodiment of promotional system 20 of the present invention is depicted. In this embodiment, promotional system 20 is constructed in a manner substantially identical to the construction detailed above in reference to FIG. 1. However, in order to add additional excitement and interest generating features to this construction, front panel member 21 is constructed within large cut out zone 40 formed therein, along with a plurality of smaller cut out zones 41. Although not required, cut out zones 40 and 41 are all preferably formed in flap portion 35 of front panel member 21.

In addition, in order to further enhance the unique visual distinctive characteristics of this embodiment of the present invention, and add additional exciting and interest generating features, separate and independent internal panel 43 is mounted between panel members 21 and 22. In the preferred construction, internal panel 43 is securely sandwiched between the portions of panel members 21 and 22 forming holdings zone/section 31, and comprises an overall length enabling panel 43 to extend beyond fold line 32, into the open area formed between flaps 35/36 and 37/38.

Furthermore, any desired indicia is preferably printed on internal panel 43, with the indicia being constructed for being easily seen through cut out zone 40 when promotional system 20 is in its compact, folded position. In this way, when promotional system 20 is in its closed or compact position, the indicia printed on internal panel 43 is easily viewable through cut out zone 40.

In addition, in order to further enhance the visual capabilities of the present invention, indicia is also printed on flap 36 of front panel 21 in position for being viewable through cut out zones 41 when promotional system 20 is in its compact, folded position. Furthermore, by printing additional distinctive indicia on flap 37 of rear panel member 22, with the indicia being constructed for being viewable through cut out zones 40 and 41, a further distinctive visual presentation is attainable with the indicia being seen through cut out zones 40 and 41 changing whenever promotional system 20 is moved from its first, compact position to its second, fully extended position.

In FIG. 3 another alternate embodiment of the present invention is depicted. In this embodiment, promotional system 20 is constructed in an overall manner substantially identical to the construction detailed above. However, in this particular configuration, holding zone/section 31 and flaps 36 and 38 are formed into a plurality of separate and independent extendable members 45.

In the preferred construction, extendable members 45 are formed by cutting holding zone/section 31 and flaps 36 and 38 into a plurality of separate and independent parallel segments. In this way, each segment 45 is capable of being extended independently of its adjacent segment, thereby providing a unique and visually distinctive presentation.

Furthermore, by incorporating pertinent indicia on segments 45, any desired theme can be emphasized with each segment having to be separately removed to reveal a portion of the desired theme. However, other than forming a plurality of separate and independent segments 45, all of the other features of construction detailed above are incorporated into this embodiment.

In FIG. 4, a still further alternate embodiment of the present invention is fully shown. In this embodiment, promotional system 20 comprises two separate portions or display panel assemblies which are separately movable between a compact position and a fully extended position. In effect, this embodiment of the present invention is constructed in a manner virtually identical to the construction detailed above in reference to FIG. 1. However, in this embodiment, two outer display panel assemblies 47 and 48 are constructed in cooperating engagement with holding zone/section 31.

As depicted, holding zone/section 31 is constructed with flaps 36 and 38 of panel members 21 and 22 of each display panel assemblies 47 and 48 extending from both side edges thereof. As result, holding zone/section 31 comprises a centrally located display panel which is hidden from view in the compact position, with folded flaps 35, 36, 37, and 38 of both extendable display panels assembly 47 and 48 peripherally surrounding and enclosing holdings zone/section 31 when in the closed position. In addition, when display panel assemblies 47 and 48 are moved into their fully extended configuration, all of the outer surfaces of display panel assembly 47 and 48 as well as holding zone section 31, are fully displayed.

By employing this embodiment of the present invention, a unique visually distinctive construction is realized, with optimum, hands on effort be required by the user. In addition, a substantially elongated display assembly is attained, enabling sponsors of promotional system 20 to have increased surface area up on which any desired indicia, advertisement, message, etc. can be fully displayed. In addition, in this embodiment, the snapping or cracking sound is produced when either panel assembly 47 or panel assembly 48 is moved between its two alternate positions.

In FIG. 5, a further alternate embodiment of the present invention is depicted. In this embodiment, promotional system 20 comprises a substantially rectangular or square shaped panel assembly 50 having a front surface and a rear surface on which any desired indicia, message, advertising information, etc. is displayed. In addition, in order to further emphasize a particular aspect of the message being delivered, as well as provide a user with the ability to impact upon the message being revealed, each of the corners of panel assembly 50 incorporates a hidden, folded, extendable portion 51, constructed in a manner similar to the extendable configurations detailed above. However, instead of extending the folded portion from a side edge, extendable portions 51 are mounted to each of the corners of panel assembly 50, producing an alternate, unique construction and visually distinctive configuration.

As is evident from the disclosure of the construction shown in FIG. 5, as well as the disclosure of the other various embodiments of this invention, a wide variety of alternate configurations can be implemented employing various selected features of the disclosed constructions. In this regard, promotional system 20 may be constructed with an extendable portion affixed to one or more corners of the panel assembly, while also incorporating extendable portions coming from one or more side edges thereof. In this way, a wide variety of visual appearances can be obtained.

Further alternate embodiments of the present invention are depicted in FIGS. 6 and 7, which are similar to the embodiment detailed in FIG. 5, along with a further variation thereof. In the embodiment depicted in FIG. 6, panel assembly 50 is constructed with extendable portion 51 being formed as extending from a side edge thereof in a generally jackknifed configuration. In an alternate embodiment, FIG. 6 depicts panel assembly 50 with extendable portion 51 extending from one corner thereof to provide a partially exposed display portion.

In FIG. 8, a further alternate embodiment of the present invention is depicted. In this embodiment, promotional system 20 is constructed in a manner substantially identical to the constructions detailed above in reference to FIGS. 1 and 4. However, in this embodiment, as a further exciting, visually distinctive, and interest generating feature, promotional system 20 incorporates die-cut, pop-up element 53 integrally formed as a part of front panel member 21. Although die-cut, pop-up element 53 may comprise any desired shape, configuration, indicia or pictorial representation, die-cut, pop-up element 53 is depicted as a sunburst, for exemplary purposes only.

In the preferred construction of this embodiment of the present invention, die-cut, pop-up element 55 is formed in front panel member 21 in the portions thereof which are folded when promotional system 20 is in its compact configuration. As a result, whenever the activating panels of promotional system 20 are axially moved for causing promotional system 20 to move from its first, compacted configuration into its second, fully extended configuration, die-cut, pop-up element 55 is revealed in a unique exciting and interest generating manner. Furthermore, by printing any desired indicia, promotional information, messages, color elements, etc. on the exposed surfaces of promotional system 20, the sponsor obtains a unique promotional system with added interest generating features and message delivery capabilities.

In FIG. 9, a still further alternate embodiment of the present invention is depicted. In this embodiment, promotional system 20 comprises a frame member 54 which incorporates cut out zone 55 formed therein. In the preferred construction, frame member 54 incorporates a front panel 56 and a rear panel 57 which are affixed to each other along their side edges.

In addition, display assembly 60 is mounted with frame member 54, positioned within cut out zone 55 for being viewable therethrough. By constructing display assembly 60 in the manner detail below, alternate images are displayed and quickly and easily changed from one display to another display by user activation.

In this regard, in the preferred construction, display assembly 60 incorporates front panel 61 on which a desired indicia is displayed. As discussed above, this indicia may comprise any desired message, colors, alphanumeric designations, etc., which the sponsor wishes to convey to the use. In addition, panel 61 is interconnected to pull tab 62. By drawing pull tab 62 outwardly from frame member 54, front panel 61 is forced to pivot about pivot axis or fold line 63. Once tab 61 is fully withdrawn from frame assembly 54, panel 64 is displayed, revealing a second separate and independent indicia which the sponsor wishes to present to the user.

By employing this further alternate embodiment of the present invention, any desired image or indicia can be quickly and easily altered between a first image/indicia and a second image/indicia. Furthermore, if desired, rear panel 57 of this embodiment of promotional system 20 can be constructed in a manner substantially identical to front panel 56, thereby enabling the user to enjoy two separate and independent images/indicia alternately displayed on both the front and rear surfaces thereof.

By employing the teaching of the present invention as detailed above, numerous alternate constructions, configurations, and variations can be made for achieving alternate embodiments of promotional system 20. As examples of these and numerous alternate configurations and constructions, further alternate embodiments of the present invention are depicted in FIGS. 12, 13, and 14.

In each of these Figures, alternate constructions of promotional system 20 are depicted, with each alternate construction employing the teaching provided above. However, in each of these embodiments, the construction elements and features detailed above have been combined in alternate combinations, thereby achieving a unique promotional system 20 having a visually distinctive visual appearance. However, in spite of the unique visual appearance of these alternate embodiments, each embodiment incorporates a combination of features and/or construction details thoroughly discussed and fully disclosed in the foregoing alternate embodiments.

In FIGS. 12 and 13, the promotional system 20 shown therein incorporates the basic configuration depicted in FIG. 1 and described above, along with the cutout zones depicted in FIG. 2 and described above. In addition, promotional system 20 shown in FIG. 12 also incorporates the changing picture features depicted in FIG. 9 and described above.

In promotional system 20 of FIG. 13, the features described above in relationship to FIG. 12 are employed therein, along with the construction features shown in FIG. 4 and detailed above, where promotional system 20 expands from two opposite directions. As is evident from these additional embodiments, numerous alternate unique constructions and configurations can be achieved using the features of the present invention.

Finally, in FIG. 14, a further alternate embodiment employing the teaching of the present invention is depicted. In this embodiment, the embodiments of FIG. 1, FIG. 2, and FIG. 9 are combined and further enhanced by having a display element peripherally surrounded by a frame member supported by rubber bands or string. In this way, a display panel is capable of being provided which is suspended in a movable frame assembly.

It will thus be seen that the object set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is:

1. A promotional display system constructed for movement between a first compact position and a second extended position for providing an exciting and interest generating display, said system comprising:

A. a housing formed from a plurality of substantially flat panel members cooperatively associated with each other and comprising a) a first holding plate forming a first side edge of the housing and constructed for enabling a user to easily grasp the first holding plate, and b) a second holding plate forming a second side edge of the housing, positioned opposite from the first side edge, and constructed for enabling the user to easily grasp the second holding plate; and B. a foldable panel assembly a) mounted to the first holding plate on a first side edge of the panel assembly and mounted to the second holding plate on a second side edge of the panel assembly, b) comprising a first panel member and a second panel member cooperatively associated with each other, positioned in juxtaposed, spaced, overlying, cooperating relationship, c) each panel member incorporating a fold line formed therein, said fold line forming a pivot axis in each panel member and establishing a first plate member and a second, adjacent plate member in each of said panel members, for enabling the second plate member of the first panel member and the second plate member of the second panel member to be simultaneously movable about the fold line formed in said panel member between a first, compact position wherein said second plate member of each panel member is in juxtaposed, spaced, aligned relationship with a portion of the first plate member thereof, and a second, extended position, wherein said second plate member of each panel member is arcuately pivoted away from the first plate member into a position directly adjacent the first plate member in a substantially side to side relationship, and d) constructed for enabling the foldable panel assembly to be movable between its first, compact, plate member overlying position into its second, extended, plate member adjacent position by longitudinally moving the second holding plate relative to the first holding plate;

whereby a promotional display system is achieved which enables a user to continuously enjoy an exciting and interest generating display by repeatedly moving the first holding plate and the second holding plate along a single, longitudinally extending axis.

2. The promotional display system defined in claim 1, wherein the second holding plate is further defined as comprising an overall length which enables said second holding plate to extend beyond the fold line of each of said first and second panel members when the housing is in its first, compact position, thereby enabling the second holding plate to be easily reached and grasped by the user for movement thereof from the first compact position to the second extended position.

3. The promotional display system defined in claim 1, wherein said system is further defined as being constructed from a first elongated, substantially flat panel member and a second elongated, substantially flat panel member, with said first and second panel members being positioned in overlying, cooperating relationship with each other, each of said panel members having a first side edge and a second side edge with the first side edge of the first panel member being affixed to the first side edge of the second panel member, while the second side edge of the first panel member is affixed to the second side edge of the second panel member, the first side edges of said first and second panel members forming a portion of the first holding plate and the second side edges of the first and second panel members forming a portion of the second holding plate.

4. The promotional display system defined in claim 3, wherein said foldable panel assembly is formed by intermediate portions of the first panel member and the second panel member which extend between the first side edge and second side edge of each of the first and second panel members.

5. The promotional display system defined in claim 4, wherein the arcuate pivoting movement of the first plate member and the second plate member of each of said panel members about their respective fold lines simultaneously produces a snapping or cracking noise by causing the surfaces of the first plate member and the second plate member of the first panel member to contact the first plate member and the second plate member of the second panel member.

6. The promotional display system defined in claim 5, wherein a noise enhancing plate is mounted extending between the first plate member and the second plate member for cooperatingly pivoting with the movement of the plate members in a manner which produces enhanced production of the cracking or snapping sound.

7. The promotional display system defined in claim 6, wherein the display system further comprises an interior support plate mounted to the second rigid panel member and extending therefrom into the area formed between the first plate members and the second plate members, with the interior support plate being constructed for enhancing the overall construction and display provided by the promotional display system.

8. The promotional display system defined in claim 7, wherein the interior support plate is further defined as being constructed for securely holding a desired product thereon and presenting the product to the user whenever the display system is moved into its fully extended configuration.

9. The promotional display system defined in claim 8, wherein the product supported on the interior support plate comprises one selected from the group consisting of compact discs, DVDs, and computer disks.

10. The promotional display system defined in claim 4, wherein the first panel member and the second panel member incorporate indicia printed thereon for enhancing the visual presentation of the promotional display system.

11. The promotional display system defined in claim 10, wherein the first panel member incorporates a plurality of apertures formed therein positioned for cooperating with indicia printed on the inside surfaces of the second panel member for providing a further enhanced visual effect.

12. The promotional display system defined in claim 11, wherein the display system further comprises an interior support plate mounted to the second rigid wall member and extending therefrom into the area formed between the first plate member and the second plate member, with the interior support plate incorporating indicia printed thereon and positioned for cooperating with the apertures formed on the first panel for enabling the indicia to be visible through the apertures when the display system is in its compact position.

13. The promotional display system defined in claim 4, wherein the first, substantially rigid wall member incorporates a plurality of slots formed therein, for effectively dividing the wall member into a plurality of separate and independent segments, with each of said segments being separately movable relative to each other, thereby providing a promotional display system which incorporates a plurality of movable segments individually displayable in response to consumer activation.

14. The promotional display system defined in claim 4, wherein the first panel comprises three-dimensional, foldable die cut elements formed on the walls thereof constructed for being movable between a compact position and a fully extended position simultaneously with the movement of the display system from its compact position to its fully extended position, thereby further enhancing the excitement and interest provided by the display system.

15. The promotional display system defined in claim 4, wherein the first panel member and the second panel member incorporate an additional pair of arcuately pivotable, foldable wall portions cooperatively associated with the overlying side edges thereof for providing an enhanced longitudinally extending display system movable from a compact position to a fully extended position.

16. The promotional display system defined in claim 4, wherein the first panel member and the second panel member each comprise substantially enlarged flat rectangular shapes with the fold lines thereof being formed at each of the corners, thereby providing a promotional display wherein longitudinally extendable foldable display elements are movable from a compact position to an extended position by activating the folded portions formed at the corners thereof.

17. The promotional display system defined in claim 4, wherein the display system further comprises a frame assembly peripherally surrounding the first panel member and the second panel member effectively establishing an enlarged cut out zone within which the first panel member and the second panel member are positioned, with a portion of the first rigid wall member extending outwardly from the frame assembly for enabling the first panel member and second panel member to be longitudinally moved between its compact position and fully extended position within the cut out zone of the frame assembly.

18. The promotional display system defined in claim 17, wherein said display system incorporates eye-catching, visually exciting indicia printed on the first panel member and the second panel member for producing an interest generating and visually exciting effect whenever the display system is moved from its first compact position to its second fully extended position, with that movement occurring within the cut out zone of the frame assembly.

19. The promotional display system defined in claim 4, wherein the first holding plate form by the first panel member and the second panel member is further defined as being constructed as a first substantially rigid wall member, while the second holding plate form by the first panel member and the second panel member is further defined as being constructed as a second substantially rigid wall member, thereby enabling said panel members to be easily grasped, held, and employed by the user.

20. A promotional display system constructed for movement between a first compact position and a second extended position for providing an exciting and interest generating display, said system comprising:

A. a housing formed from a plurality of substantially flat panel members cooperatively associated with each other and comprising
   a) a first holding plate forming a first side edge of the housing and constructed for enabling a user to easily grasp the first holding plate, and
   b) a second holding plate forming a second side edge of the housing, positioned opposite from the first side edge, and constructed for enabling the user to easily grasp the second holding plate;

B. a foldable panel assembly
   a) mounted to the first holding plate on a first side edge of the panel assembly and mounted to the second holding plate on a second side edge of the panel assembly,
   b) comprising a first panel member and a second panel member cooperatively associated with each other, positioned in juxtaposed, spaced, overlying, cooperating relationship,
   c) each panel member incorporating a fold line formed therein, said fold line forming a pivot axis in each panel member and establishing a first plate member and a second, adjacent plate member in each of said panel members, for enabling the second plate member of the first panel member and the second plate member of the second panel member to be simultaneously movable about the fold line formed in said panel member between a first, compact position wherein said second plate member of each panel member is in juxtaposed, spaced, aligned relationship with a portion of the first plate member thereof, and a second, extended position, wherein said second plate member of each panel member is arcuately pivoted away from the first plate member into a position directly adjacent the first plate member in a substantially side to side relationship,
   d) constructed for enabling the foldable panel assembly to be movable between its first, compact, plate member overlying position into its second, extended, plate member adjacent position by longitudinally moving the second holding plate relative to the first holding plate, and
   e. said first plate member of the first panel member being further defined as incorporating a plurality of cut-out zones formed therein and said first plate member of said second panel member being further defined as comprising indicia printed on an inside surface thereof aligned with the cut-out zones for enabling the indicia to be viewable through the cut-out zones when the panel assembly is in its second, extended position; and C. a movable plate incorporating printed indicia on a surface thereof and mounted to the second holding plate and extending therefrom into a position between the first panel member and the second panel member with the printed indicia being positioned for enabling the indicia to be viewed through at least one cut-out zone formed in the first plate member of the first panel member when said foldable panel assembly is in its first, compact position;

whereby a promotional display system is achieved which enables a user to continuously enjoy an exciting and interest generating display by repeatedly moving the first holding plate and the second holding plate along a single, longitudinally extending axis.

* * * * *